US008919274B1

(12) United States Patent
Chen et al.

(10) Patent No.: US 8,919,274 B1
(45) Date of Patent: Dec. 30, 2014

(54) SUBMERSIBLE VEHICLE WITH HIGH MANEUVERING CYCLIC-PITCH POSTSWIRL PROPULSORS

(71) Applicants: Benjamin Y. - H. Chen, Potomac, MD (US); Stephen K. Neely, Herndon, VA (US)

(72) Inventors: Benjamin Y. - H. Chen, Potomac, MD (US); Stephen K. Neely, Herndon, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/899,011

(22) Filed: May 21, 2013

(51) Int. Cl.
*B63G 8/08* (2006.01)
*B63G 8/16* (2006.01)

(52) U.S. Cl.
CPC ... *B63G 8/08* (2013.01); *B63G 8/16* (2013.01)
USPC ..... 114/330; 114/338

(58) Field of Classification Search
USPC ..... 440/321, 330, 338; 114/321, 330, 338
IPC ..... B63G 8/08
See application file for complete search history.

(56) References Cited

U.S. PATENT DOCUMENTS

| | | | | | |
|---|---|---|---|---|---|
| 2,727,485 | A | * | 12/1955 | Combs | 114/321 |
| 3,101,066 | A | * | 8/1963 | Haselton | 114/330 |
| 3,703,211 | A | * | 11/1972 | Bernaerts | 440/79 |
| 4,648,345 | A | | 3/1987 | Wham et al. | |
| 5,445,105 | A | | 8/1995 | Chen et al. | |
| 6,482,054 | B2 | | 11/2002 | Treaster et al. | |
| 6,981,844 | B2 | | 1/2006 | Perkinson et al. | |

* cited by examiner

*Primary Examiner* — Stephen Avila
(74) *Attorney, Agent, or Firm* — Dave A. Ghatt

(57) ABSTRACT

A submersible vehicle with increased payload and energy savings, more particularly, a submersible vehicle, which may be an unmanned underwater vehicle, with high maneuvering cyclic-pitch postswirl propulsors. The high maneuvering cyclic-pitch postswirl propulsor arrangements are a bow thrust vectoring arrangement and a stern thrust vectoring arrangement. The bow thrust vectoring arrangement is a two-part arrangement having a forward/reverse element and a turning element. Similarly, the stern thrust vectoring arrangement is also a two-part arrangement having a forward/reverse element and a turning element.

5 Claims, 6 Drawing Sheets

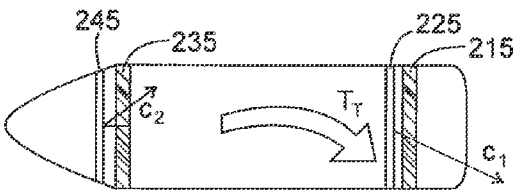
Figure 4A
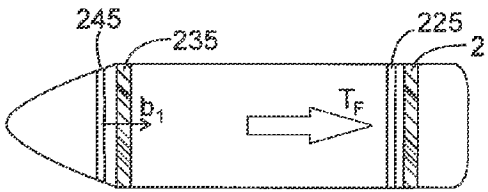
Figure 4B
Figure 4C
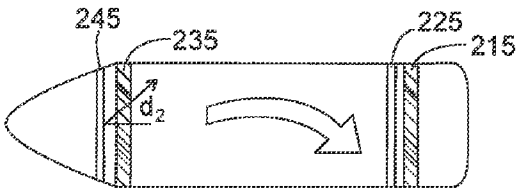
Figure 4D
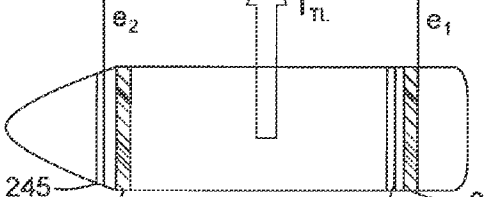
Figure 4E
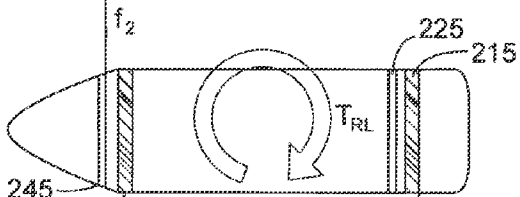
Figure 4F
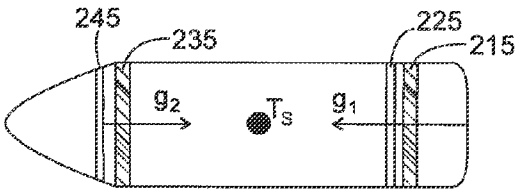
Figure 4G
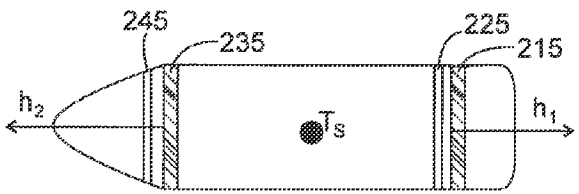
Figure 4H

SUBMERSIBLE VEHICLE WITH HIGH MANEUVERING CYCLIC-PITCH POSTSWIRL PROPULSORS

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a submersible vehicle with increased payload and energy savings, more particularly, a submersible vehicle, which may be an unmanned underwater vehicle, with advanced maneuverability cyclic-pitch postswirl propulsor.

BACKGROUND

There is tremendous interest unmanned underwater vehicles (UUVs) for remotely performing functions such as exploring, sensing and mapping, or retrieving items e.g. UUVs allow a mother ship to safely gain access to denied areas such as extremely shallow water, very poor acoustic conditions, or mined waters. Therefore, UUVs provide unique capabilities and extend the reach of a mother ship whilst reducing the risk to the mother ship and its crew.

Existing UUVs encounter many challenges during operations which include precise station keeping, tight tactical maneuvers in hostile environments such as mined waters as well as retrieval of UUVs for mother ships. Existing UUVs generally employ a single propeller with the control surfaces at the stern to provide standard maneuvering capability but not the ability to face the operations challenges. This results from traditional control surfaces requiring forward speed in order to produce turning moments. In addition, the residual torque generated by the propeller needs to be balanced by the control surfaces, which generates additional drag for the vehicle and thus increases the power consumption.

The prior art of Haselton, as shown in FIGS. 1A and 1B, includes a propeller arrangement that provides a solution to many of the abovementioned challenges. FIGS. 1A and 1B show the Haselton submersible vehicle 10 having a vehicle body 11 with bow and stern hub propellers 21 and 22. According to this prior art design, the propellers 21 and 22 rotate in a contra-rotating mode using cyclic blade pitch to produce side forces. This design provides both conventional maneuvers such as forward/reverse, forward/reverse turns, as well as unconventional maneuvers such as sideways translation, turning-in place and station-keeping/hovering in place.

However, the Haselton vehicle payload has been sacrificed because of the helicopter swash plate assembly used to implement the cyclic-pitch system. The swash plate assembly which includes linkages to for tilting the propellers occupies more space than desired. The complexity of this design may cause reliability concerns. This design also utilizes a lot of energy, which is not desired. For example, in order to achieve stability, both propellers 21 and 22 should be operated contemporaneously. When only one propeller is operated, a residual torque is generated which must be balanced by a control surface such as a stabilizer 30. This results in increasing the power consumption of the vehicle 10. Also, the forward propeller 21 operates in an inefficient environment because its positioning facilitates a minimal boundary layer flow. In addition to those inefficiencies, the propellers 21 and 22 are separated so that the aft propeller 22 can't recover the swirl energy from the forward propeller 21, leading to even more energy losses. Thus, it is desired to have a submersible vehicle that provides maneuverability similar to the Haselton vehicle, but has a simpler design that does not sacrifice the payload, and is more energy efficient.

SUMMARY

In one aspect, the invention is a submersible vehicle. In this aspect, the submersible vehicle has a vehicle body having a bow and a stern. The submersible vehicle also includes a propulsion system to propel the vehicle body through the water. According to the invention, the propulsion system includes a bow thrust vectoring arrangement having a bow fixed-pitch rotor at the bow end for generating forward and reverse thrust, and a bow cyclic-pitch postswirl stator arrangement downstream of the bow fixed pitch rotor, for generating sideways forces. The propulsion system also includes a stern thrust vectoring arrangement having a stern fixed-pitch rotor at the stern end for generating forward and reverse thrust, and a stern cyclic-pitch postswirl stator arrangement downstream of the bow fixed pitch rotor, for generating sideways forces.

BRIEF DESCRIPTION OF THE DRAWINGS

Other features will be apparent from the description, the drawings, and the claims.

FIGS. 4A-4H are exemplary illustrations of maneuvers performed by the submersible vehicle, according to embodiments of the invention.

DETAILED DESCRIPTION

Figure 1A:
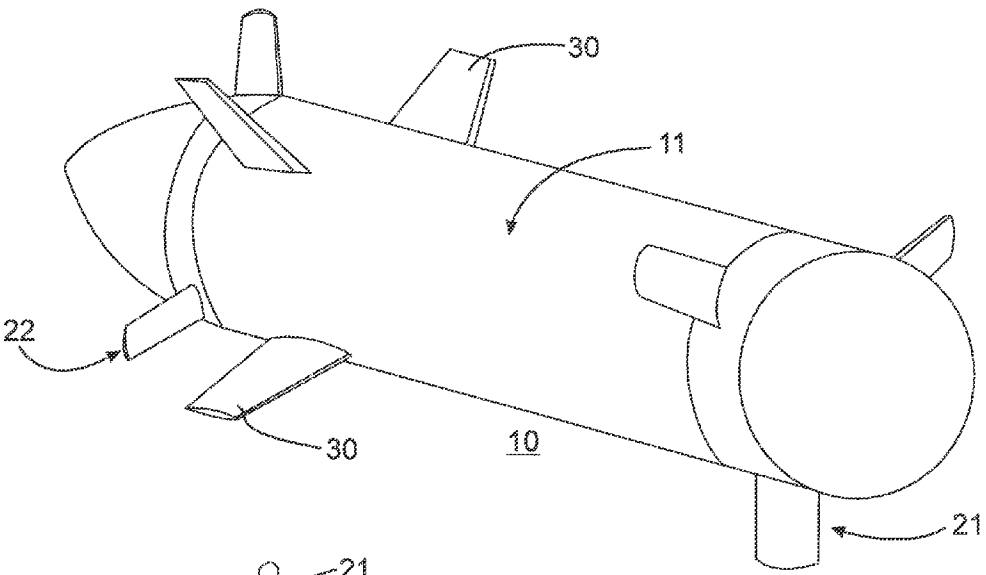
Figure 1A (Prior Art)
FIG. 1A is a perspective illustration of a prior art submersible vehicle including bow and stern propeller arrangements.
Figure 1B:
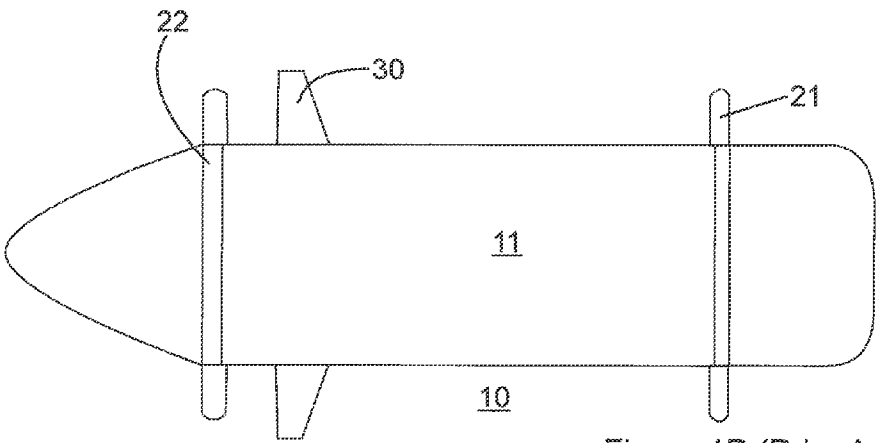
Figure 1B (Prior Art)
FIG. 1B is side view of a prior art submersible vehicle including bow and stern propeller arrangements.
Figure 2A:
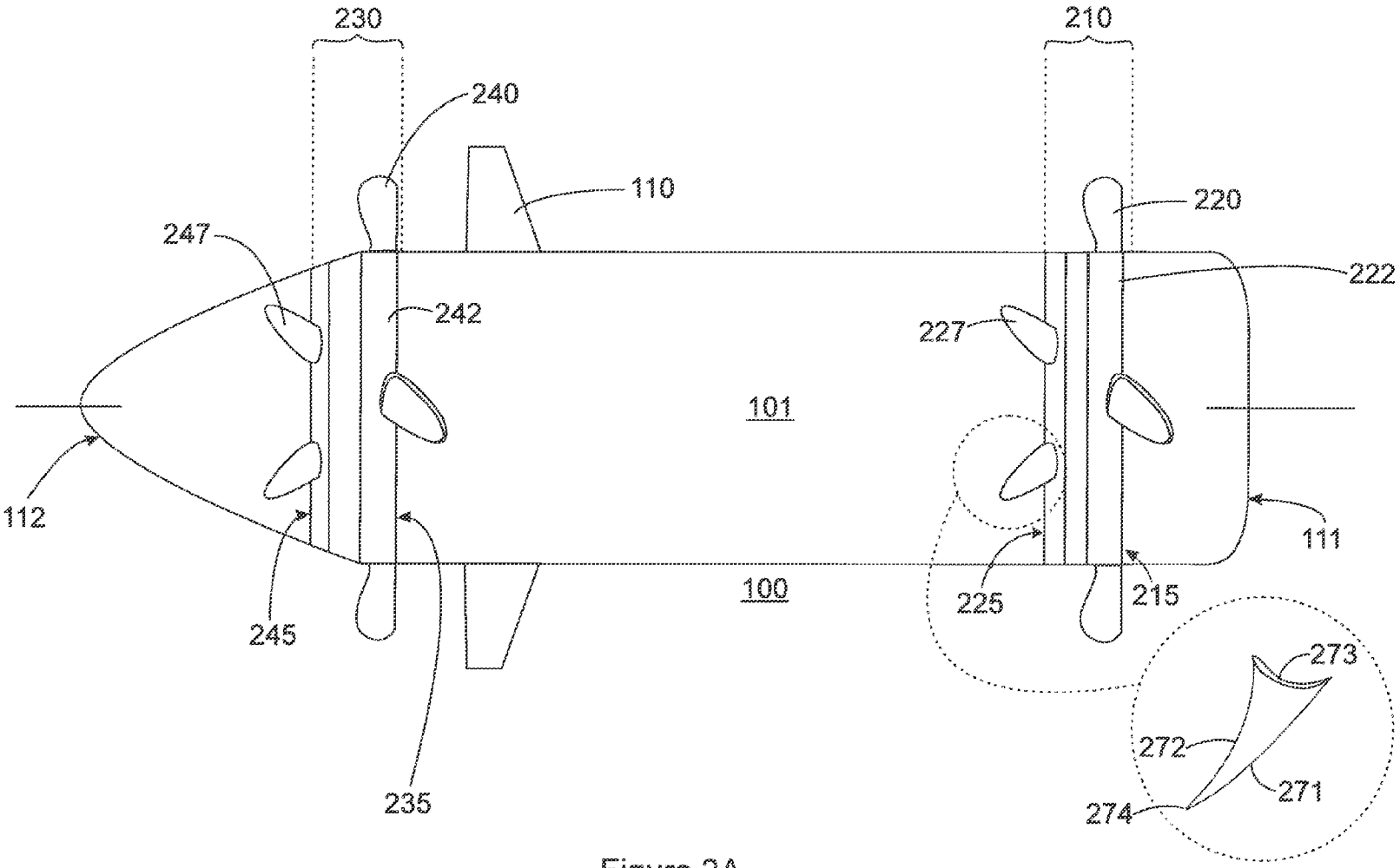
FIG. 2A is an exemplary side view of a submersible vehicle, with high maneuvering cyclic-pitch postswirl propulsor arrangements, according to an embodiment of the invention.
Figure 2B:
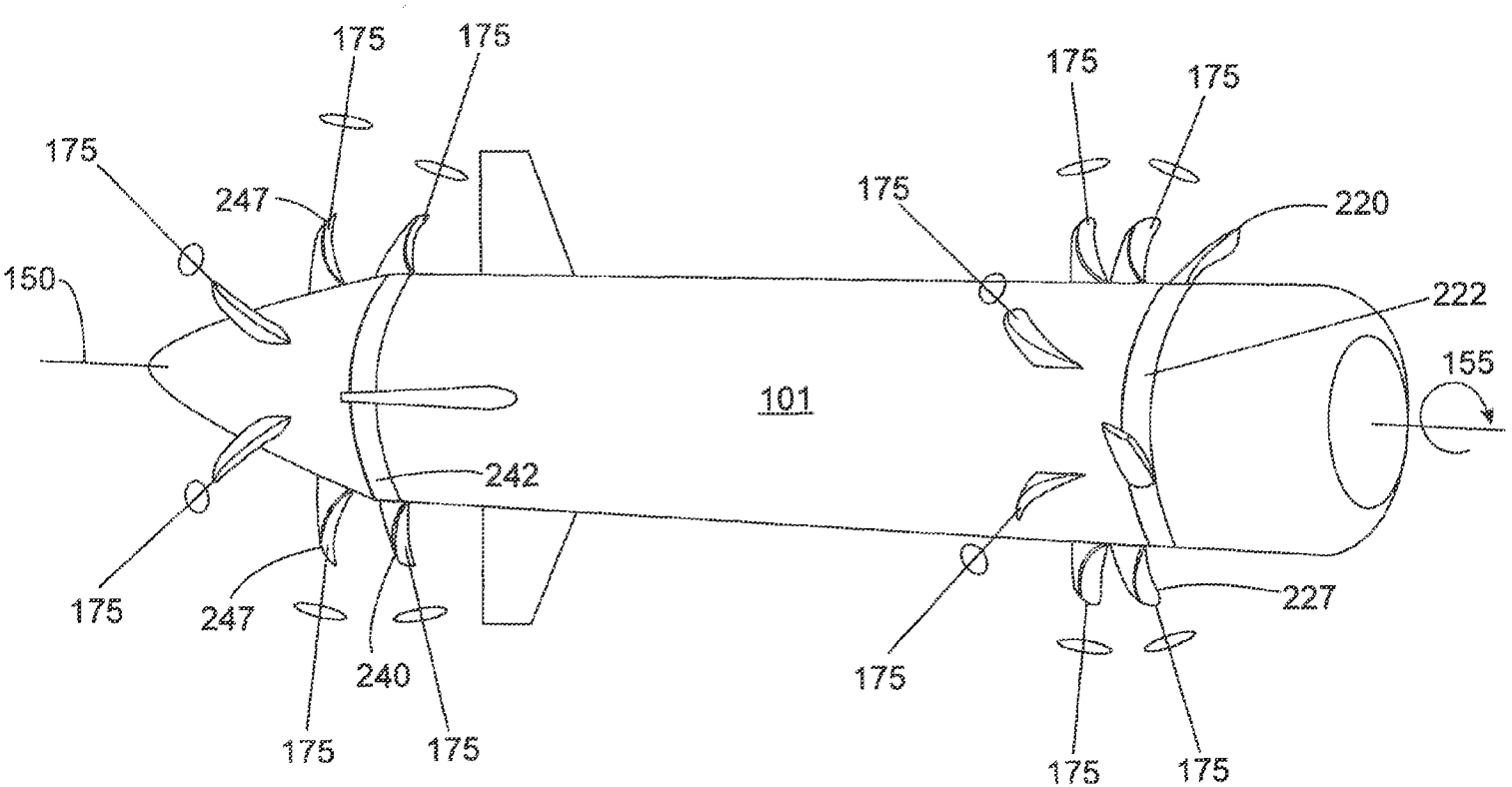
FIG. 2B is an exemplary side view of a submersible vehicle, with high maneuvering cyclic-pitch postswirl propulsor arrangements, according to an embodiment of the invention.

FIGS. 2A and 2B are exemplary illustrations of a submersible vehicle 100, having advanced maneuverability cyclic-pitch postswirl propulsor arrangements, according to an embodiment of the invention. The submersible vehicle 100 may be an unmanned underwater vehicle (UUV) for remotely performing functions, such as exploring, data mining, or retrieving items. FIGS. 2A and 2B show the submersible vehicle 100 having a vehicle body 101 with a bow 111 and a stern 112. According to an embodiment, the vehicle body 101 is substantially cylindrical, however, the vehicle body 101 may be any desired shape that would function properly as a submersible vehicle. The submersible vehicle 100 may optionally include stabilizers 110 as shown.

As shown in FIG. 2A, the high maneuvering cyclic-pitch postswirl propulsor arrangements are actually a bow thrust vectoring arrangement 210 and a stern thrust vectoring arrangement 230. As shown, the bow thrust vectoring arrangement 210 and the stern thrust vectoring arrangement 230 are both mounted on the body 101 of the submersible vehicle 100. The bow thrust vectoring arrangement 210 and the stern thrust vectoring arrangement 230 are both two-part arrangements with a rotor and a cyclic pitch postswirl stator arrangement downstream of the rotor. FIG. 2A shows the bow trust vectoring arrangement 210 having a fixed-pitch rotor 215 and a cyclic pitch postswirl stator arrangement 225 downstream of the fixed-pitch rotor 215. Similarly, the stern trust vectoring arrangement 230 has a fixed-pitch rotor 235 and a cyclic pitch postswirl stator arrangement 245 downstream of the fixed-pitch rotor 235. As outlined below, the fixed-pitch rotors (215, 235) provide forward and reverse thrust for the submersible vehicle. The cyclic pitch postswirl stator arrangements (225, 245) provide sideways movement, and in combination with the rotors (215, 235) provide rotational movement.

As shown in FIGS. 2A and 2B, the fixed-pitch rotor 215 has fixed-pitched blades 220, mounted on a ring 222. The ring 222 is mounted so that it is rotatable, as shown by arrow 155, about the longitudinal axis 150. Similarly, the fixed-pitch rotor 235 has fixed-pitched blades 240, mounted on a ring 242. The ring 242 is mounted so that it is also rotatable about the longitudinal axis 150. As shown, the rings (222, 242) have a diameter that is substantially equal to the diameter of the vehicle body 101. The diameter of the rings (222, 242) may also be smaller than the diameter of the vehicle body 101. When the rings (222, 242) rotate, the blades (220, 240) follow the circular path of the ring. The rotors (215, 235) may each be rotated in forward or reverse direction. Thus, each rotor (215, 235) may individually provide a forward or reverse thrust force, which pushes the submersible vehicle 100 in a forward or a reverse direction. The fixed-pitch blades (220, 240) may have any dimensions as known in the art, suitable for proper performance according to the environmental conditions.

FIGS. 2A and 2B also show the cyclic pitch postswirl stator arrangements (225, 245). The cyclic pitch postswirl stator arrangement 225 is made up of a plurality of vanes 227, which are positioned at the surface of the vehicle body 101. The plurality of vanes 227 are fixed with respect to the longitudinal axis 150. However, each vane 227 is mounted so that they can swivel or rotate about a respective swivel axis 175. Similarly, the cyclic pitch postswirl stator arrangement 245 is made up of a plurality of vanes 247, which are positioned at the surface of the vehicle body 101. The plurality of vanes 247 are fixed with respect to the longitudinal axis 150. However, each vane 247 is mounted so that they can swivel or rotate about a respective swivel axis 175. Each vane (227, 247) may be mounted on a hub (228 and 248 shown schematically in FIG. 3) that facilitates the swiveling/rotating. As shown, FIG. 2B shows a plurality of swivel axes 175. Each of the plurality of swivel axes 175 extend outward from the outer surface of the vehicle body 101 through one of the plurality of vanes 227. According to an embodiment of the invention, each postswirl stator arrangement (225, 245) may have six vanes (227, 247) but the postswirl arrangements (225, 245) may have more or less vanes (227,247), depending on operational requirements. As shown in the blown-up section in FIG. 2A, each vane (227, 247) may have a leading edge 271 and a trailing edge 272 that defines its chord length, and a root 273 and a tip 274 that defines its span. Vane chord lengths and other dimensions may vary depending on the application. The vanes (227, 247) may be attached to the respective hub at their root 273, and as outlined below, the angle of rotation of each vane (227, 247) about the respective swivel axis 175 determines that sideways or turning force on the submersible vehicle 100.

As stated above, the bow thrust vectoring arrangement 210 is a two-part arrangement, including a forward/reverse element 215, and a turning element 225. Similarly, the stern thrust vectoring arrangement 230 is also a two-part arrangement, including a forward/reverse element 235, and a turning element 245. As outlined below, this arrangement is extremely versatile, allowing for conventional and non-conventional maneuvers. However, because of the simplicity of the design, the two-part thrust and turning arrangements, i.e., thrust vectoring arrangements (210, 230) there is no swash plate or other cumbersome mechanical linkages, which increase the payload of the vehicle. Additionally, each of the two-part thrust vectoring arrangements (210, 230) may be operated one at a time, without producing any significant residual torque, diminishing any requirement for a control surface such as the stabilizer 110. For example, when the bow thrust vectoring arrangement 210 is switched off, the stern thrust vectoring arrangement 230 may be turned used, and there would be no significant residual torque on the submersible vehicle 100. Thus, as opposed to the prior art, it is not necessary to operate both thrust vectoring arrangements (210, 230) to achieve stability. Thus, according to the invention, a stabilizer 110 as shown may not be necessary.

Figure 2C:
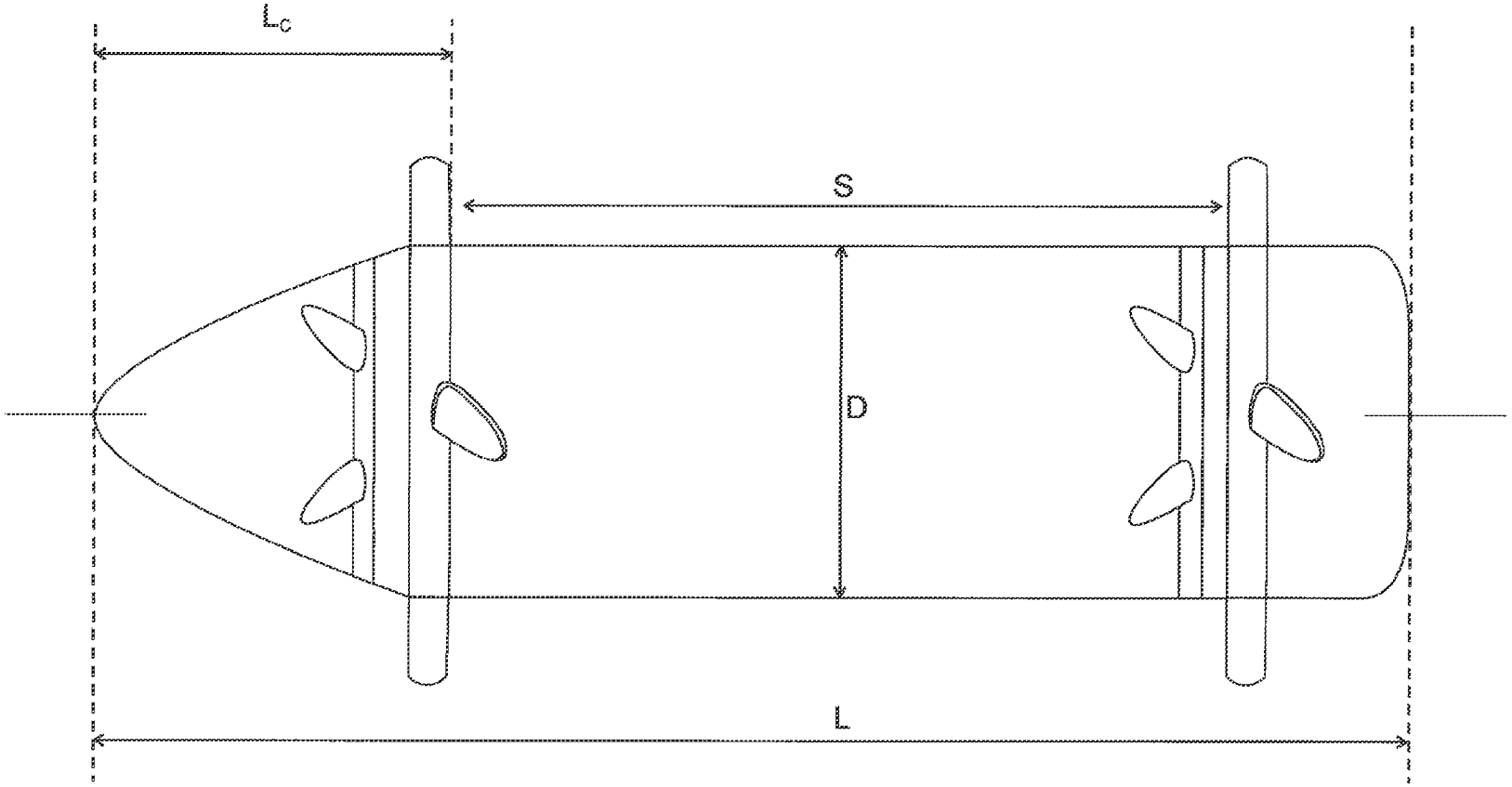
FIG. 2C is an exemplary perspective illustration of a submersible vehicle showing dimensions, according to an embodiment of the invention.

FIG. 2C is an exemplary illustration showing dimensions of the submersible vehicle 100, according to an embodiment of the invention. According to an embodiment, the vehicle body 101 is substantially cylindrical with a conical shape stern at the stern 112 and a blunt round shape at the bow 111. As shown, the vehicle body has an overall length L, and a diameter D. The length of the conical part as shown is $L_C$. The thrust vectoring arrangements (210, 230) are separated from each other by a distance S. According to an embodiment, the length $L_C$ is about 0.25 L, the diameter D is about 0.125 L to about 0.167 L to minimize resistance. According to an embodiment, the distance S is about 0.7 L to about 0.9 L. It should be noted that ratios outlined represent exemplary embodiments of the vehicle 100, and it is understood that the submersible vehicle may be dimensioned larger or smaller in accordance with operation requirements. There is no preferred dimension or restriction for the submersible vehicle 100. Consequently, the thrust vectoring arrangements (210, 230) could be applied to submersible vehicles of different dimensions or shapes.

Figure 3:
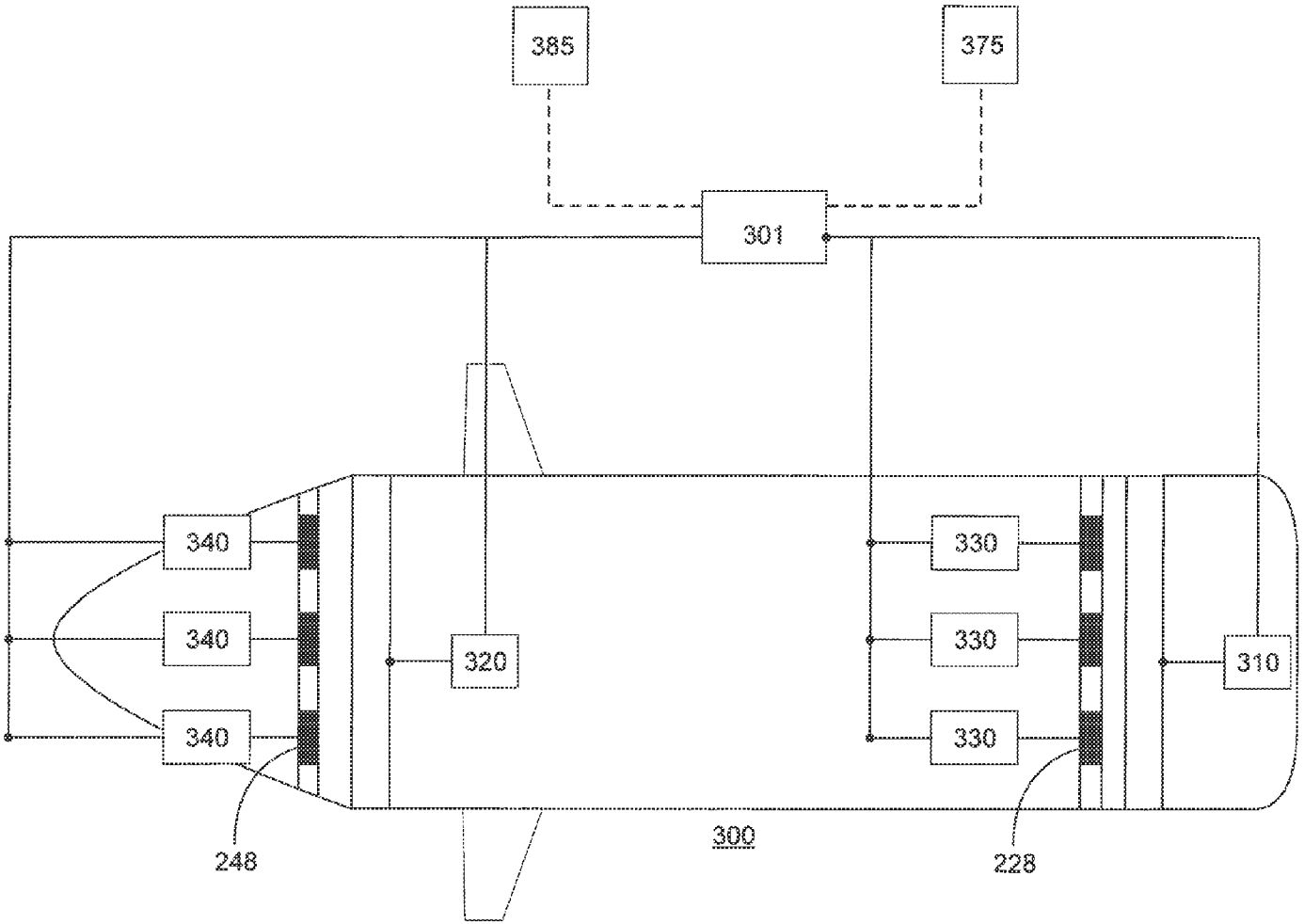
FIG. 3 is an exemplary schematic illustration of the submersible vehicle, including the controller arrangement, according to an embodiment of the invention.

FIG. 3 is an exemplary schematic illustration of the submersible vehicle, including the controller arrangement 300 and associated elements, according to an embodiment of the invention. FIG. 3 shows a bow motor 310 for driving the bow fixed-pitch rotor 215 and a stern motor 320 for driving the stern fixed-pitch rotor 235. The motors (310, 320) may preferably be shaftless motors. As opposed to the prior art vehicles with swash plate arrangements having cumbersome gearing assemblies, in which shaftless motors would not work, the uncomplicated design of the outlined invention allows for the use of shaftless motors, all contributing to the increase in payload. The motors (310, 320) may each be a reversible shaftless electric motor, such as a shaftless servo motor or the like, or any known similar motor capable of driving the respective rotors (215, 235) in forward and reverse directions. As stated above, the forward and reverse propulsion of the submersible vehicle 100 is facilitated by driving the rotors (215, 235) in the forward and reverse directions. It should be noted that the use of bow motor 310 and the stern motor 320 at opposite ends of the vehicle body 101 simplifies the mechanical design of the submersible vehicle 100, and allows for increased payload.

FIG. 3 also shows a plurality of vane actuators 330 connected to the hubs 228 of the cyclic pitch postswirl stator arrangement 225, and a plurality of vane actuators 340 connected to the hubs 248 of the cyclic pitch postswirl stator arrangement 245. It should be noted that the number of vane actuators (330, 340) match the number of hubs (228, 248), and each actuator (330, 340) powers the rotation of the respective vanes (227, 247) about the respective swivel axis 175. As stated above, the cyclic pitch postswirl stator arrangements (225, 245) operate in conjunction with the rotors (215, 235), providing sideways and rotational movement. The angle of the sideways movement with respect to the forward and reverse thrust directions is determined by the angle of rotation of the vanes (227, 247) about the respective swivel axis 175.

As shown in FIG. 3, the controller arrangement 300 includes a vehicle processor 301 for controlling the movement of the submersible vehicle. The vehicle processor 301 is electronically connected to the motors (310, 320), and the plurality of vane actuators (330, 340). The vehicle processor 301, which includes a known main memory system, controls operations that include amongst other things, speed and direction controls. By controlling the actuation of the motors (310, 320) and the vane actuators (330, 340) the processor 301 may control the maneuvering of the submersible vehicle 100 by initiating forward and reverse movements, forward and reverse turns, sideways translations, turning in place, and station-keeping. As stated above, the motors (310, 320) may be preferable be shaftless motors or the like.

As shown in FIG. 3, the controller arrangement 300 may include a host device 375 that is remote from the submersible vehicle 100. According to this embodiment, the host device 375 may be a computer having a central processing unit that interfaces wirelessly with the vehicle processor 301. The host device 375 may be equipped to run one or more mission control programs for directing the movement of the submersible vehicle 100. Alternatively, the submersible vehicle 100 may not require the host device 375, and may be controlled via interface with an input device 385, such as a touchpad, joystick, or the like which interfaces directly with the vehicle processor 301. Alternatively, the submersible vehicle 100 may programmed to operate autonomously without input from an external source.

FIGS. 4A-4H are exemplary illustrations of maneuvers performed by the submersible vehicle 100, according to embodiments of the invention. FIG. 4A is an exemplary illustration of forward/reverse maneuver. FIG. 4B is another exemplary illustration of forward/reverse maneuver. FIG. 4C is an exemplary illustration of a forward/reverse turn. FIG. 4D is another exemplary illustration of a forward/reverse turn. FIG. 4E is an exemplary illustration of sideways translation. FIG. 4F is an exemplary illustration of turning in place. FIG. 4G is an exemplary illustration of station-keeping/hovering in place. FIG. 4H is another exemplary illustration of station-keeping/hovering in place.

The illustrated maneuvers are accomplished by actuating one or both of the bow thrust vectoring arrangement 210 and the stern thrust vectoring arrangement 230 to achieve the desired motion. As outlined above, the bow thrust vectoring arrangement 210 includes a member 215 that produces forward/reverse motion, and a member 225 that produces turning motion. Similarly, the stern thrust vectoring arrangement 230 includes a member 235 that produces forward/reverse motion, and a member 245 that produces turning motion. As outlined above, the vehicle processor 301 controls the actuation of the motors (310, 320) and the plurality of vane actuators (330, 340), thereby controlling forward/reverse motions and turning motions.

Regarding the maneuvering shown in FIG. 4A for example, forward thrust $T_F$ may be achieved by the processor 301, which controls both the bow thrust vectoring arrangement 210 and the stern thrust vectoring arrangement 230. The processor 301 may actuate the bow motor 310 for driving the bow fixed-pitch rotor 215 in a forward direction, and the stern motor 320 for driving the stern fixed-pitch rotor 235 in a forward direction as shown by arrows $a_1$ and $a_2$. Depending on the initial orientation of the cyclic pitch postswirl stator arrangements (225, 245), the processor 301 may initiate the plurality of vane actuators (330, 340) to rotate the plurality of stator vanes (227, 247) about their respective swivel axis 175, so that there is no turning or sideways motion, thereby ensuring only a forward thrust $T_F$. Because both the bow thrust vectoring arrangement 210 and the stern thrust vectoring arrangement 230 are substantially identical, a reverse thrust $T_R$ is achieved by doing the opposite, i.e., actuating the motors (310, 320) in the reverse direction.

Regarding the maneuvering shown in FIG. 4B, the thrust $T_F$ may also be achieved when the processor 301 actuates only one of the bow thrust vectoring arrangement 210 and the stern thrust vectoring arrangement 230. As opposed to prior art arrangements, forward/reverse stability may be achieved by operating only the bow arrangement 210 or only the stern arrangement 230 because both these arrangements include a cyclic pitch postswirl stator arrangement (225, 245) that prevent sideways motion, thereby stabilizing the submersible vehicle 100. Thus, according to this embodiment, the processor 301 actuates the bow motor 310 for driving the bow fixed-pitch rotor 215 in a forward direction, or the stern motor 320 for driving the stern fixed-pitch rotor 235 in a forward direction. If the stern motor 320 is initiated by the processor 301, the processor may then may initiate the plurality of vane actuators 340 to rotate the plurality of stator vanes 247, about their respective swivel axis 175, so that there is no turning or sideways motion. This creates a desired forward thrust $T_f$. Although not illustrated, the forward thrust $T_f$ may also be achieved by initiating the bow motor 310 and the vane actuators 330 to rotate the plurality of stator vanes 227, also creating the desired forward thrust $T_f$. A $T_f$ in the opposite direction may be achieved by doing the opposite, i.e., actuating the respective motors (310, 320) and vane actuators (330, 340) in the reverse direction.

As with FIGS. 4A and 4B, the FIGS. 4C-4H illustrations involve similar actuation protocol. FIGS. 4A and 4B have been outlined in detail as the maneuvers are exemplary of processes involving both of the bow thrust vectoring arrangement 210 and the stern thrust vectoring arrangement 230 (as shown in FIG. 4A), and alternatively only one of the bow thrust vectoring arrangement 210 and the stern thrust vectoring arrangement 230 (as shown in FIG. 4B). The maneuvers of FIGS. 4A and 4B result from actuating one or both of the bow thrust vectoring arrangement 210 and the stern thrust vectoring arrangement 230 to achieve the desired motion. As stated above, the vehicle processor 301 controls the actuation of the motors (310, 320) and vane actuators (330, 340), thereby controlling forward/reverse motions and turning motions. The controlled maneuvers shown in FIGS. 4C-4H are self-evident from the illustrations because the steps of controlling are similar to what has been outlined with respect to FIGS. 4A and 4B. However, the maneuvers illustrated in FIGS. 4C-4H are summarized as outlined below.

FIG. 4C shows a turning motion initiated by actuating both the bow thrust vectoring arrangement 210 and the stern thrust vectoring arrangement 230, with the processor 301 initiating the motors (310, 320) in a forward direction, and vane actuators (330, 340) so that they rotate about the swivel axis 175 to produce the sideways motion shown by the arrows $c_1$ and $c_2$. This produces the desired turning thrust $T_T$. FIG. 4D shows a turning motion initiated by actuating only the stern thrust vectoring arrangement 230, with the processor 301 initiating the motor 320 in a forward direction, and vane actuator 340 so that they rotate about the swivel axis 175 to produce the sideways motion shown by the arrow $d_1$ resulting in the desired turning thrust $T_t$.

FIG. 4E shows a translation maneuver initiated by actuating both the bow thrust vectoring arrangement 210 and the stern thrust vectoring arrangement 230, with the processor 301 initiating the motors (310, 320) in either a forward or reverse direction, and vane actuators (330, 340) so that they rotate about the swivel axis 175 to produce a resulting motion that is perpendicular to the forward direction, as shown by the arrows $e_1$ and $e_2$. Because both $e_1$ and $e_2$ point in the same direction, the resulting thrust $T_{TL}$ translates the vehicle 100.

FIG. 4F shows a rotation maneuver initiated by actuating both the bow thrust vectoring arrangement 210 and the stern thrust vectoring arrangement 230, with the processor 301 initiating the motors (310, 320) in either a forward or reverse direction, and vane actuators (330, 340) so that they rotate about the swivel axis 175 to produce a resulting motion that is perpendicular to the forward direction, as shown by the arrows $f_1$ and $f_2$. Because $f_1$ and $f_2$ are forces in opposite directions as shown, the resulting thrust $T_{RT}$ rotates the vehicle 100.

FIGS. 4G and 4H are examples of station-keeping/hovering in place, initiated by actuating both the bow thrust vectoring arrangement 210 and the stern thrust vectoring arrangement 230, with the processor 301 initiating the motors (310, 320) in opposite directions, and vane actuators (330, 340) if necessary to prevent any sideways motion. Thus, although not illustrated, the sideways force may be created by the vane actuators (330, 340) if necessary, to add stability to station-keeping operations. FIG. 4G shows the resulting station keeping force $T_s$ resulting oppositely directed forces $g_1$ and $g_2$ pointing towards each other, and FIG. 4H shows the resulting station keeping force $T_s$ resulting oppositely directed forces $h_1$ and $h_2$ pointing away from each other. It should be noted that similar what was outlined with respect to FIGS. 4A and 4B, forces in directions opposite to those illustrated may be achieved by rotating the motors (310, 320) and vane actuators (330, 340) in opposite directions. For example, with respect to FIG. 4F, rotation in a reverse direction may be accomplished by controlling the motors (310, 320) and vane actuators (330, 340) so that the resultant $f_1$ and $f_2$ are directed opposite to the direction shown.

What has been described and illustrated herein are preferred embodiments of the invention along with some variations. Nevertheless, it will be understood that various modifications may be made. For example, as opposed to the substantially cylindrical vehicle body with the conical end and the round end, the vehicle body may have any desired shaped that properly accommodates for underwater travel. Also, depending on the shape of the vehicle body, the fixed-pitch rotors may include blades mounted on a hub, as opposed to blades mounted on a rotatable ring. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A submersible vehicle comprising:

a vehicle body having a bow and a stern; and a propulsion system to propel the vehicle body through the water, the propulsion system comprising:

a bow thrust vectoring arrangement comprising;

a bow fixed-pitch rotor at the bow end for generating forward and reverse thrust, and a bow cyclic-pitch postswirl stator arrangement downstream of the bow fixed pitch rotor, for generating sideways forces, and a stern thrust vectoring arrangement comprising;

a stern fixed-pitch rotor at the stern end for generating forward and reverse thrust, and a stern cyclic-pitch postswirl stator arrangement downstream of the stern fixed pitch rotor, for generating sideways forces, wherein each of the bow cyclic-pitch postswirl and stern cyclic-pitch postswirl stator arrangements comprise a plurality of vanes positioned circumferentially along an outer surface of the vehicle body, and wherein the each of the bow fixed-pitch rotor and the stern fixed-pitch rotor comprise a plurality of fixed-pitch blades mounted on a rotatable ring, and wherein the submersible vehicle includes a longitudinal axis extending axially through the vehicle body, and wherein each of the bow fixed-pitch rotor and the stern fixed-pitch rotor are rotatably mounted with respect to the longitudinal axis, and wherein each of the bow cyclic-pitch postswirl and stern cyclic-pitch postswirl arrangements are stationary with respect to the longitudinal axis, the submersible vehicle further comprising a plurality of swivel axes, each of the plurality of swivel axes extending outward from outer surface of the vehicle body through a respective vane of the plurality of vanes wherein each of the plurality of vanes are rotatably mounted with respective swivel axis, wherein the angle of rotation of each vane about the swivel axis determines the amount of sideways force generated.

2. The submersible vehicle of claim 1, further comprising a bow motor for driving the bow fixed-pitch rotor and a stern motor for driving the stern fixed-pitch rotor, and a plurality of vane actuators, each of the plurality of actuators associated with one of the plurality of vanes for rotating the associated vane about the respective swivel axis.

3. The submersible vehicle of claim 2, further comprising a vehicle processor for controlling the movement of the submersible vehicle, the vehicle processor electronically connected to each of the bow motor and stern motors, and the plurality of vane actuators, wherein by controlling the operation of the bow and stern motors and the plurality of vane actuators, the vehicle processor controls maneuvers including, forward and reverse movements, forward and reverse turns, sideways translations, turning in place, and station-keeping.

4. The submersible vehicle of claim 3, wherein the vehicle body has a substantially cylindrical shape with the longitudinal axis extending down the center of the cylinder, the bow of the cylinder being substantially round and the stern having a conical shape, and wherein the rotatable rings of each of the of the bow fixed-pitch rotor and the stern fixed-pitch rotor has a diameter substantially equal to or smaller than a diameter of the vehicle body.

5. The submersible vehicle of claim 4, wherein each of the bow motor and the stern motor is a shaftless motor.

* * * * *